United States Patent [19]

Midorikawa

[11] 4,093,769

[45] June 6, 1978

[54] CAPILLARY BODY AND METHOD OF PRODUCING THE SAME

[75] Inventor: Yoshio Midorikawa, Tokyo, Japan

[73] Assignee: Glasrock Products, Inc., Fairburn, Ga.

[21] Appl. No.: 665,622

[22] Filed: Mar. 10, 1976

[30] Foreign Application Priority Data

Feb. 18, 1976 Japan ..... 51-16849

[51] Int. Cl.[2] ..... B43K 1/12; D04H 3/14

[52] U.S. Cl. ..... 428/295; 156/180; 156/296; 156/305; 156/306; 264/128; 401/198; 427/244; 428/297; 428/304; 428/394

[58] Field of Search ..... 19/157; 57/138; 156/180, 305, 296, 306, 331, 77, 87; 264/45.8, 45.9, 46.1, 172, 174, 128, 41, 271, 258, 46.4, 46.7; 427/245, 244, 246, 341, 342, 385 B, 390 R, 358; 401/198

[56] References Cited

U.S. PATENT DOCUMENTS

| | | | |
|---|---|---|---|
| 3,400,998 | 9/1968 | Daugherty et al. | 401/198 |
| 3,432,446 | 3/1969 | Coppeta | 260/2.5 |
| 3,443,984 | 5/1969 | Stewart | 264/174 X |
| 3,461,197 | 8/1969 | Lemelson | 264/174 X |
| 3,502,417 | 3/1970 | Hartmann | 401/202 |
| 3,558,392 | 1/1971 | Goodenow et al. | 156/180 |
| 3,562,374 | 2/1971 | Okamoto et al. | 264/174 X |
| 3,767,520 | 10/1973 | Dick et al. | 401/198 |
| 3,864,183 | 2/1975 | Hori | 401/198 |
| 3,881,828 | 5/1975 | Jones | 401/199 |

FOREIGN PATENT DOCUMENTS

| | | | |
|---|---|---|---|
| 800,211 | 12/1968 | Canada | 401/198 |
| 1,418,087 | 10/1965 | France | 401/198 |
| 1,561,844 | 4/1970 | Germany | 401/198 |
| 44-26,687 | 12/1969 | Japan | 401/198 |

*Primary Examiner*—Michael R. Lusignan

*Attorney, Agent, or Firm*—Lane, Aitken, Dunner & Ziems

[57] ABSTRACT

A fibre bundle is first formed of entangled fibres by use of a tapered mold of an extruder. Then, the fibre bundle thus formed is dipped into an urethane prepolymer to fill the spaces among fibres by impregnating it with said prepolymer. After removal from the liquid prepolymer, it is left for a period of time to allow the reactions among the constituents in the prepolymer and the volatilization of solvent generate gases to form gas escape holes or capillary passages along the length of the fibre bundle.

8 Claims, 4 Drawing Figures

CAPILLARY BODY AND METHOD OF PRODUCING THE SAME

CROSS-REFERENCE TO RELATED APPLICATIONS

This application is related to the following copending applications: U.S. Ser. No. 702,067, filed July 2, 1976, entitled "A METHOD FOR PRODUCING A WRITING PEN CORE HAVING A NIB PORTION INTEGRAL WITH AN INK RESERVOIR"; U.S. Ser. No. 694,524, filed June 10, 1976, entitled "METHOD OF MANUFACTURING A MARKING PEN HAVING A NIB AND AN INK RESERVOIR INREGRAL THEREWITH"; and U.S. Ser. No. 694,525, filed June 10, 1976, entitled "METHOD FOR MANUFACTURING A MARKING PEN HAVING A NIB AND AN INK RESERVOIR INTEGRAL THEREWITH".

FIELD OF THE INVENTION

The present invention relates to a capillary body for transudation of liquid which may be formed into any suitable shape such as rod, annulus and the like, and to a method of manufacturing the same.

DESCRIPTION OF THE PRIOR ART

Capillary bodies for transudation of liquid are well known in the art. One of the typical prior art products is a "felt" consisting only of complicatedly entangled fibres. Also, a plastic material may be extruded by use of a mold or die and thereafter be extended into a capillary tube having a cross section corresponding to the shape of the mold or die. Furthermore, another technique has been developed wherein threads, after twining, may be impregnated with a suitable plastic so that they may be bonded and bridged into the form of the capillary body.

The last mentioned prior art method has the disadvantages that it requires the step of twining thin threads, it is difficult to use short slivers which results in expensive manufacturing cost, etc.. Also, as an inevitable result of twining threads spaces available among fibre threads would be defined, so that the effective capillary amount after the impregnation of plastic may not be artificially controlled over the wide range, which is an elementary defect. In the second prior art mentioned above, the amount of effective capillary (voids) depends upon the shape of the mold used for the production of the capillary body. A mold normally has a symmetrical configuration to maintain its strength against the pressure of the extrusion and thus it is very difficult to obtain capillaries havng complicated shapes, as a result of which it has been found difficult to control the effective capillary amount over a wide range.

SUMMARY OF THE INVENTION

Therefore, the object of the invention is to provide a method of producing a capillary body having an effective capillary amount which may be varied over a wider range than could have been accomplished heretofore.

The another object of the invention is to provide a method of producing the capillary body with a lower cost utilizing wastes such as cottons fibres, rather than expensive material such as spinned threads.

The other object of the invention is to provide a method of forming very complicated capillary passages in that, instead of simply bridging and bonding fibres with plastics, wide spaces among fibres which are loosely entangled are filled with an urethane prepolymer to thereafter bridge or bond them upon polymerization of the urethane prepolymer. The reaction of the prepolymer with water and the volatilization of the volatile solvent to form very complicated capillary passages among resultant urethane plastics portions impregnated in the wider voids among fibres due to the generation of gases as stated above.

The still another object of the invention is to provide a capillary body which may be produced in accordance with the method as above described, and which can apply to any suitable application by working such as machining with an appropriate tool.

To accomplish the above and other objects, according to the present invention, an aggregation of short slivers or cotton fibres available at low cost may be first formed to a predetermined size with an extruder or the like. Then a skin may be formed over the fibers by a material such as vinyl chloride. Thus, the voids left among the slivers occupy a larger amount of the capillary body according to the present invention than that of the existing one. In such a body, voids may reach a surprising extent of 80 - 90 % by volume of the body. Alternatively, the formation of the skin may be accomplished by the heating operation without utilization of other materials. The skin serves also to guide gas (for example carbon dioxide) as will be described hereinafter and volatilized gas in a desired direction.

Subsequently, a portion or the whole of the capillary body material thus manufactured is dipped into the urethane prepolymer as will be explained in detail hereinafter to fill the wider voids among fibres. Thereafter, the material is removed from the liquid prepolymer, left as it is for a while and heated if necessary. Then, the prepolymer is subjected to the polymerization reaction to produce urethane. The polyurethane thus produced is heat set and at the same time gases are generated which escape longitudinally in the resultant urethane filled in the volume defined by the skin to leave therein complicated gas escape passages. These passages along which gases escaped are fixed as they are to result in the formation of complicated capillary. Also, the urethane prepolymer may comprise a suitable gas generating agent such as $(NH_4)HCO_3$, $(NH_4)_2CO_3$, 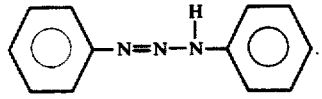 .

The complexity of the capillary passages thus formed permits larger volume per unit length of the capillary passage.

The volume occupied by the capillary (amount of void space) can be controlled by the adjustment of the amount of gases per unit volume. Also, the choice of size of slivers as well as the adjustment previously stated enable control of the size and volume of capillary passages and thus the rate and amount of transudation of liquid used such as ink, liquid gas, lubricating oil etc.

The capillary body manufactured in accordance with the present invention has a sufficient flexibility, a good wear-resistance, and a good workability, and can be used in various applications for transudation of liquid by working with an appropriate tool.

BRIEF DESCRIPTION OF THE DRAWING

Various embodiments of the invention will now be described in more detail with reference to the drawing in which.

Figure 1:
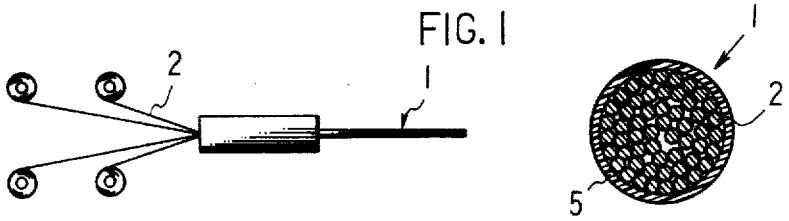
FIG. 1 is a schematic view illustrating the formation of a fibre bundle in a conventional manner and a sectional view of the bundle thus produced.

DESCRIPTION OF THE PREFERRED EMBODIMENTS:

In FIG. 1 is shown a schematic view illustrating the formation of the fibre bundle 1 from fibres 2 in this case from threads on a plurality of spools. As illustrated in section at the righthand side of FIG. 1, the fibre threads are twined into the fibre bundle from several spools having thin threads thereon. In the present invention, there is no need for dense distribution of fibres, loosely entangled aggregations such as cotton before spinned into threads are compressed and formed to a desired shape and size by a tapered die in an extruder or the like.

A skin is formed on the outer surface of the compressed fiber bundle. The skin can be formed of vinyl chloride at the same time the fibers are extruded or later. Alternatively, the skin can be formed directly from the fiber material 2 by heating the outer surface of the bundle.

Figure 2:
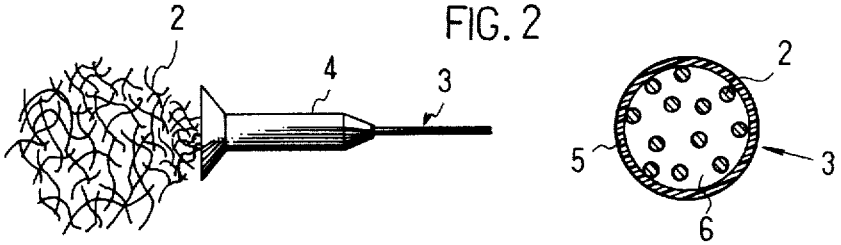
FIG. 2 is a schematic view illustrating the formation of a fibre bundle according to the method of the present invention and a sectional view of the bundle thus produced.
Figure 3:
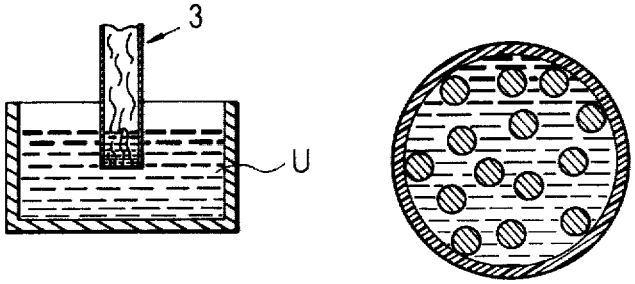
FIG. 3 is a schematic view illustrating the dipping of the fibre bundle into the urethane prepolymer and a sectional view of the fibre bundle impregnated with said prepolymer.
Figure 4:
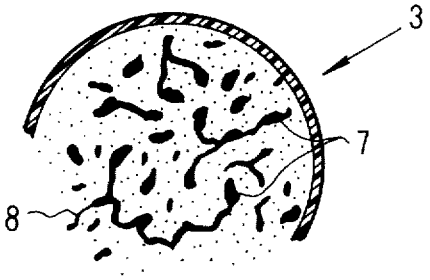
FIG. 4 is a sectional view of the finished capillary body in accordance with the method of the present invention.

Subsequently, in a manner as illustrated in FIG. 3, a portion or the whole of the fiber bundle 3 thus obtained is dipped into the urethane prepolymer U. The urethane prepolymer used in the specification and claims means a material which produces polyurethane upon polymerization of the constituents in the prepolymer at a predetermined condition, and is available in the market or mixed. Then, the prepolymer is substantially filled in the larger space in the fibre bundle. This means, as will be described hereinafter, that a larger space left in the fibre bundle after the formation at the extruder enables the control of the void space in the finished capillary body over a wider range. The percentage of voids in the fiber bundle produced in a manner as illustrated in FIG. 2 reaches the extent of 80 - 90 % by volume of the fibre bundle. On the contrary, it is difficult in the method illustrated in FIG. 1 to exceed 60 volume % even if very thin threads are used for the fibre bundle.

After impregnation of prepolymer in the fibre bundle it is picked out of the liquid prepolymer and left as it is for a while. The constituents of the prepolymer mainly consist of isocyanate, polyol, solvent, water and a catalyst for promoting urethane production. During polymerization carbon dioxide is generated by the reaction of isocyanate with water, and volatilization of the solvent occurs. The polyurethane bridges the loosely entangled fibres. The heating promotes setting of polyurethane. Also, the generation of carbon dioxide and the volatilization of solvent provide a number of gas escape passages in the polyurethane thus produced. These gas escape passages are formed, due to the existence of the skin on the periphery of the bundle, along the fibres within the skin. Alternatively, said prepolymer may contain a suitable a gas generating agent as stated previously.

The most important portion of the process according to the present invention will now be described in more detail.

First, the fibre bundle becomes set due to the production of polyurethane with aid of catalyst and or by heating, and at the same time the volatilization of the prepolymer solvent is effected. The gas generated by the volatilization of solvent, owing to the fact that the skin covers the periphery of the fibre bundle, is guided by fibres scattered within the volume defined by the skin to escape the impregnated fibre bundle resulting in the formation of the capillary body. Thus, a great number of gas escape passages or holes for transudation of liquid 7 are formed within the impregnated fibre bundle with an outer skin.

Simultaneously with the formation of the transudation holes 7 due to the volatilization of solvent, the reaction of isocyanate with water contained in the prepolymer generates carbon dioxide. Carbon dioxide gas thus generated can by itself produce the primary passages 7, but the need of longer time for reaction of isocyanate with water delays the generation of carbon dioxide gas later than the volatilization of solvent. As a result, the generated carbon dioxide gas provides not the primary passages 7, but secondary passages 8 which are formed by the escape of carbon dioxide gas into the primary passages. The passages or holes 8 thus formed also constitute capillary passages for transudation of liquid.

As stated above, the combination of both primary and secondary action provides holes or passages for transudation of liquid in a complex system, so that it is substantially difficult to specify very complicated configuration of passages. Therefore, the controls for an amount of solvent as well as an amount of generation of carbon dioxide gas will adjust the volume to be occupied by these passages, and permit a larger said space than has been obtained heretofore. For example, according to the method of the present invention a void space over 30 - 60 volume percent may be obtained.

The formation of the primary and secondary passages provides the capillary body with a sufficient rigidity and moderate elasticity. In order to generate carbon dioxide gas, the important feature is to require isocyanate of an amount exceeding that consumed for the formation of polyurethane, and further to have water contained in the prepolymer which will react with isocyanate. The formation of holes by gases is advantageous in that such holes have relatively complicated configurations and yet small diameters, besides passages among the holes which enable uniform transudation of liquid. At the same time, the volume of holes per unit length of the capillary body becomes greater, which provides flexibility suitable for various applications.

Now, the present invention will be explained in more detail with respect to several examples which are not intended to restrict the scope of the invention.

The urethane prepolymer used for carrying out the method of the present invention may comprise the following constituents. The proper choice of combinations for such prepolymer and the thickness of fibre (denier) would result in the provision of the capillary body having an amount of liquid transudation adapted to the specific application.

EXAMPLE 1

| | |
|---|---|
| Polyol 807 | 100 |
| Isocyanate TDI-65 | 6.3 |
| $H_2O$ | 3 - 8 |
| dichloroethane (solvent) | 150 |
| ethylene diamine (catalyst) | a trace |

EXAMPLE 2

| | |
|---|---|
| Polyol 3030 | 100 |
| Isocyanate TDI-80 | 50 - 100 |
| dichloroethane (solvent) | 150 - 200 |
| $H_2O$ | 3 - 8 |

EXAMPLE 3

| | |
|---|---|
| Polyol 3030 | 100 |
| Isocyanate TDI-65 | 50 - 100 |
| dichloroethane (solvent) | 150 - 200 |
| $H_2O$ | 3 - 8 |

EXAMPLE 4

| | |
|---|---|
| Polyol 807 | 100 |
| Isocyanate TDI-65 | 9.58 |
| $H_2O$ | 3 - 8 |
| dichloroethane (solvent) | 150 |
| DABCO 33LV (catalyst) | 0.3 |

EXAMPLE 5

| | |
|---|---|
| Polyol 3030 | 100 |
| Isocyanate TDI-80 | 9.58 |
| $H_2O$ | 3 - 8 |
| dichloroethane (solvent) | 150 |
| DABCO 33LV } (catalyst) | 0.3 |
| Octyl Stanate } (catalyst) | 0.3 |

Now, the chemical features of the prepolymer as listed above in several examples will be described in Tables I, II and III.

Table I

| Polyol | The number of OH groups | M.W. | OH value mg/g |
|---|---|---|---|
| (A) 3030 | 3 | 3,000 | 56 |
| (B) 2020 | 2 | 2,000 | 56 |
| (C) 202 | 3 | 3,000 | 56 |
| (D) 807 | 3 | 6,500 | 36.8 |
| (E) 375S | 8 | 500 - 600 | 375 |
| (F) 530SA | 3 | 500 - 600 | 530 |

Table II

| Isocyanate | NCO % |
|---|---|
| (a) TDI-65 | 45 - 47 |
| (b) TDI-80 | 48.3 |
| (c) MDI-CR | 30.0 - 32.0 |
| (d) MDI-PAPI | 31 |

Table III

| Polyol | Isocyanate (a) TDI-65 | (b) TDI-80 | (c) MDI-CR | (d) MDI-PAPI |
|---|---|---|---|---|

Table III-continued

| | Isocyanate (a) TDI-65 | (b) TDI-80 | (c) MDI-CR | (d) MDI-PAPI |
|---|---|---|---|---|
| (A) 3030 | 9.58 | 9.13 | 14 | 14.22 |
| (B) 2020 | 9.58 | 9.13 | 14 | 14.22 |
| (C) 202 | 9.58 | 9.13 | 14 | 14.22 |
| (D) 807 | 6.3 | 6 | 9 | 9.34 |
| (E) 375S | 64.20 | 61.14 | 95 | 95.26 |
| (F) 530SA | 90.73 | 86.41 | 134 | 134.63 |

These data in Table III show equivalent of isocyanate with respect to 100 parts of polyol.

$$\text{Equivalent of isocyanate with respect to polyol} = \frac{0.075 \times \text{OHvalue} \times \text{Polyol(parts)}}{\text{NCO (wt \%)}}$$

In the above Tables, TDI means a mixture consisting of 20 weight % of

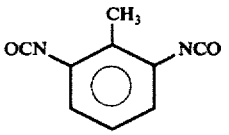

and 80 weight % of

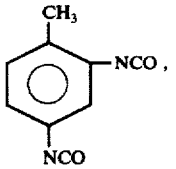

and MDI means a material having the following chemical formula

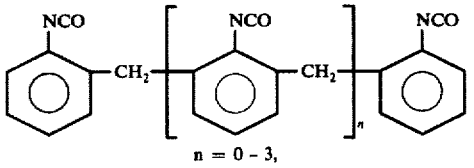

and having the mean number 2.6 - 2.8 of NCO groups.

The prepolymer as described above is preferably prepared in the following manner. The polyol and isocyanate are first mixed in the solvent at a predetermined ratio as listed above for example. However, the present invention would not be restricted to such ratios as such, rather, it has been found that the prepolymer might include five times the amount of solvent as listed above or so, thus enabling shorter drying and finishing periods and a lower heating temperature for example 40 - 80 degrees centigrade. The polyol is not restricted to those listed in the above Tables, but any kind of polyol may be used. Finally, a small amount of water and catalyst are added.

The catalyst is available in the market as the good name of DABCO which has the following chemical formula

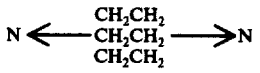

The fibre bundle was made of fibres having the thickness of about 3 denier (3.5 - 7g/m). As shown in Table 1 polyol may of course preferably have three functional groups but may have different number thereof.

The use of a catalyst for example DABCO will shorten the the setting period for the urethane.

The capillary body according to the present invention is characterized a combination of fine holes and finer holes, which permits uniform transudation of liquid so that various applications are now possible and more applications will be devised in the future.

I claim:

1. A method for producing capillary body comprising:

forming a plurality of fibers into a fiber bundle;

forming a skin around the outer periphery of said fiber bundle;

impregnating the skin-encased fiber bundle with a urethane prepolymer, water and a solvent for said prepolymer; then polymerizing said prepolymer whereby the gases generated by reaction and by volatilization of the solvent form capillary passages along said fibers.

2. The method of claim 1 wherein said fiber bundle is formed by compression of unspun cotton fiber.

3. The method of claim 1 wherein said urethane prepolymer contains an isocyanate, a polyol and a catalyst.

4. The method of claim 1 wherein a gas generating agent is mixed with the prepolymer used to impregnate the fiber bundle, said gas generating agent being selected from the group consisting of $(NH_4)HCO_3$, $(NH_4)_2CO_3$), and

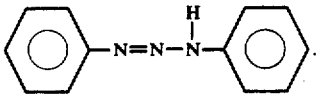

5. The method of claim 1 wherein said polymerization is promoted by heating the impregnated fiber bundle in said skin.

6. The method of claim 1 wherein said skin is formed of vinyl chloride.

7. The method of claim 1 wherein said skin is formed by melting the outer fibers of said fiber bundle.

8. The capillary product formed by the process of claim 1.

* * * * *